United States Patent [19]

Barthe et al.

[11] 4,011,795

[45] Mar. 15, 1977

[54] IMPACT TOOL

[75] Inventors: Henry P. Barthe, Pittsburgh; John S. Schroeder, Sewickley, both of Pa.

[73] Assignee: Schroeder Brothers Corporation, Pittsburgh, Pa.

[22] Filed: Mar. 24, 1975

[21] Appl. No.: 561,419

[52] U.S. Cl. ..... 91/286; 91/165; 91/320; 91/328; 91/329; 92/134

[51] Int. Cl.[2] ..... F01L 25/04

[58] Field of Search ..... 91/286, 328, 329, 165, 91/166, 276, 321, 320; 92/134

[56] References Cited

UNITED STATES PATENTS

| | | | |
|---|---|---|---|
| 53,613 | 4/1866 | Henderson | 91/286 |
| 518,026 | 4/1894 | Drewett | 91/286 |
| 3,236,441 | 2/1966 | Russell | 91/286 |
| 3,739,863 | 6/1973 | Wohlwend | 92/13 X |
| 3,774,502 | 11/1973 | Arndt | 91/321 |
| 3,827,507 | 8/1974 | Lance | 91/276 |
| 3,896,889 | 7/1975 | Bouyoucos | 91/321 |

*Primary Examiner*—Paul E. Maslousky
*Attorney, Agent, or Firm*—Webb, Bunden, Robinson & Webb

[57] ABSTRACT

A hydraulic impact tool wherein hydraulic power is used to lift a ram against a bias to store energy and wherein the ram then is permitted to accelerate toward an impliment to which it imparts energy upon impact. A reciprocating cylindrical sleeve slidable about the ram is arranged to control the hydraulic fluid. The sleeve is initially carried in each direction by the ram and is shifted relative to the ram by hydraulic power.

4 Claims, 4 Drawing Figures

IMPACT TOOL

This invention relates to hydraulic impact tools, particularly to rock drills having a drill steel driven thereby.

In recent years, great interest has developed in hydraulic impact type rock drills, among other reasons, because of the relatively low level noise they develop as compared to pneumatically driven tools. Typically, hydraulic power is used to lift a ram against an air spring or other biasing device and thereafter the ram is released permitting it to accelerate toward the drill steel. At the end of its work stroke, the ram strikes the drill steel transferring energy to it.

A shuttle valve of some type controls the application of the hydraulic fluid. Some tools have external valves. Other tools are valveless in the sense that the ram has porting and/or grooves therein which fulfill the shuttle valve functions. Still other tools have a sleeve or the like between the ram and the cylinder wall which contains porting and/or grooves for performing the shuttle valve functions. This invention relates to a hydraulic impact tool, particularly useful for rock drills which comprises an impacting mechanism having a shuttle valve of the sleeve type.

The problems of controlling and directing the hydraulic fluid in the most efficient and least complicated manner are numerous. It is well known that the impacting mechanism of hydraulic tools should permit rapid release of the hydraulic fluid from the lift chamber and cushion the ram when the tool steel is not engaged with rock. The tool described herein achieves the above stated objectives. Further, this tool is capable of achieving high impact frequency with improved impact energy per blow. It is a further advantage of this invention to provide an impact tool in which the impacting mechanism has only two moving parts; that is, the ram and the sleeve. It is a further advantage according to this invention that the frequency of the valve sleeve and the ram are always the same as the ram mechanically starts the sleeve moving in either direction.

Briefly, according to this invention, a hydraulic impact tool, useful in rock drilling, is arranged in a hydraulic system comprising a pump and reservoir. A tool housing defines a cylindrical bore having a central portion of increased diameter. The central portion of the bore forms a hydraulic cylinder. A ram including piston surfaces secured thereto is slidably positioned within the cylinder. One end of the ram enters or engages a biasing means such that the ram has a stored energy position when it is moved against the biasing means. A hollow cylindrical valve sleeve in the cylinder is movable relative to the ram and housing. Inlet, outlet and transfer porting cooperate with the sleeve to direct the hydraulic fluid from the pump to move the ram to the stored energy position and to release the ram to permit it to accelerate toward an impact position. The aforesaid means are arranged such that the ram carries the sleeve mechanically for the first part of its travel in either direction and means enable hydraulic pressure to carry the sleeve relative to the ram for the remainder of its travel in either direction.

Further features and other objects and advantages of this invention will become clear from the following detailed description made with reference to the drawings in which.

Figure 1:
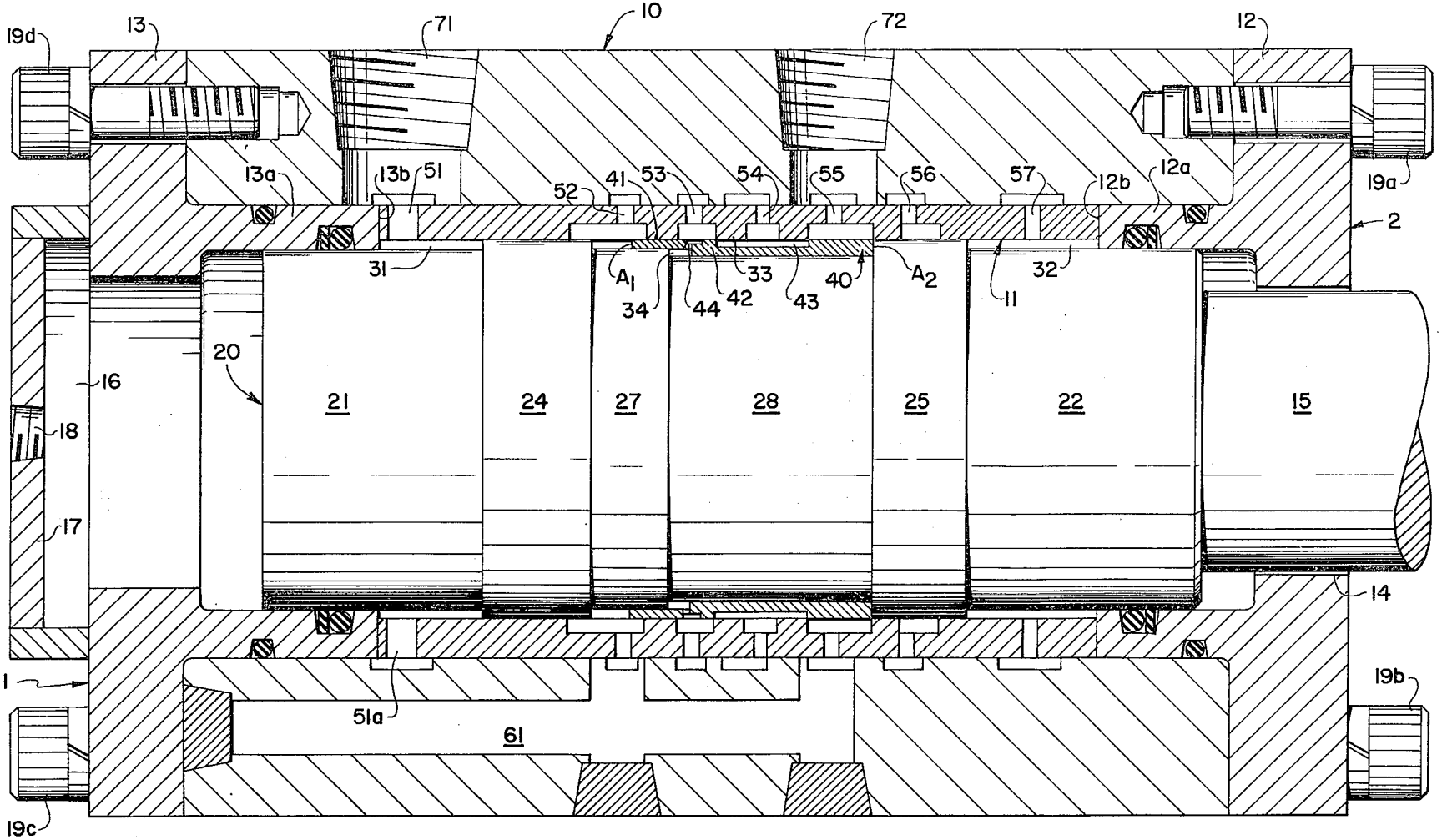
FIG. 1 is a section of an impact tool according to this invention.

Referring now to FIG. 1, the impact tool is described with reference to a stored energy end 1 and the impact or tool steel end 2.

A tool housing comprises four parts, an outer casing 10, an inner port sleeve 11 and two heads, one at the impact end 1 and the other at the stored energy end 2. The impact end head 12 has an opening 14 through which the tool steel (drill, etc.) 15 is passed. In this way, the tool steel may be driven by a reciprocating piston 20. Attached to the stored energy end head 13 is a canister 17 which with the head 13 and the ram 20 forms an airtight chamber 16. When the chamber 16 is pressurized through a fitting connectable at 18, the chamber becomes an air spring. Appropriate head bolts, 19*a*, 19*b*, 19*c* and 19*d*, etc. secure the heads to each end of the casing 10.

The heads each have a cylindrical flange 12*a* and 13*a* which slidably engages the inner surface of the casing 10. Each flange has a terminating radial surface 12*b* and 13*b*. The port sleeve 11 abuts the inner wall of the casing 10 and it is secured in place between the radial terminating surfaces 12*b* and 13*b* of the cylindrical flange 12*a* and 13*a*.

The casing 10 and the port sleeve 11 between the cylindrical flange 12*a* and 13*a* define a cylindrical bore having a central portion (the port sleeve) of section greater than the ends (the cylindrical flanges of the heads). Simply stated, the housing comprising the casing 10, port sleeve 11 and heads 12 and 13 defines a cylindrical bore having a central portion of increased section. The central portion of the bore defines a cylinder within which moves a hydraulic ram 20 with pistons 24 and 25.

Portions 21 and 22 at opposite ends of the ram 20 have equal sections arranged to slide within the inner surfaces of the cylindrical flanges 12*a* and 13*a*. The ram has a closure piston 24 and a lift piston 25 of equal section which are axially spaced between the ends of the ram. The cylindrical surfaces of the pistons slide within the port sleeve 11. The ram, between the two pistons 24 and 25, has two portions 27 and 28 of unequal section and of section less than the pistons.

The ram including pistons 24 and 25 and the cylinder define three cylindrical chambers. Two expansible (and contractable) chambers 31 and 32 are formed between the end portions 21 and 22 of the ram and the cylinder. Chambers 31 and 32 together always have the same total volume. Chamber 32 is a lift chamber because as pressure is applied thereto, the ram 20 is moved toward the stored energy end such that the ram enters chamber 16 compressing the air or gas. Chamber 31 is referred to herein as the swallow chamber because hydraulic fluid is transferred from the lift chamber 32 to the swallow chamber 31 when the ram is being accelerated toward impact.

Between pistons 24 and 25 is a fixed volume chamber 33 in which valve sleeve 40 moves. The valve sleeve 40 is cylindrical having a portion 41 of reduced thickness arranged to slide between the cylindrical bore and the portion 27 of the ram between pistons 24 and 25 having the larger section. Valve sleeve portion 41 terminates in a radial surface having an area $A_1$. The valve sleeve has another portion of increased thickness 42 that is arranged to slide between the cylindrical bore and the portion 28 of the ram between pistons 24 and 25 having the smaller section. The valve sleeve portion of increased thickness 42 terminates in a radial end having an area $A_2$. The area $A_1$ is less than the area of $A_2$. The valve sleeve has a transfer slot or groove 43 in the thick portion 42. The valve also has a purge port 44 that enables purge of the small expansible chamber 34.

Chamber 34 serves no function in the preferred embodiments of this invention but is a result of the valve sleeve geometry and the geometry of the ram. Preferably, it is purged to avoid the formation of a vacuum or spring. However, in an alternate embodiment it might house means for biasing the sleeve toward the impact end.

Port sleeve 11 has seven axially spaced ports therein, 51, 52, 53, 54, 55, 56 and 57, which are described more specifically hereafter. Each port may actually comprise a plurality of circumferentially spaced ports, for example, 51, 51a, . . . etc.

The casing 10 has bored therein, three connecting chambers for connecting the various ports; namely, a transfer chamber 63 (not shown in FIG. 1) for connecting transfer ports 54 and 57; and exhaust chamber 62(not shown in FIG. 1) for connecting ports 51, 53 and 56 with the main housing outlet port 71; and, a pressure chamber 61 for connecting ports 52 and 55 with the main housing inlet port 72.

The swallow chamber exhaust port 51 opens the swallow chamber to the hydraulic reservoir. The valve sleeve inlet port 52 opens the fixed volume chamber in the vicinity of closure piston 24 to the pump pressure to apply pump pressure to the area $A_1$ of the valve sleeve 40 at all times. The main transfer port 54 opens centrally into the fixed volume chamber 33 and the transfer chamber 63 (not shown in FIG. 1). A main exhaust port 53 opens to said fixed volume chamber 33 axially spaced between ports 52 and 54. A valve sleeve exhaust port 56 opens to said fixed volume chamber 33 when the ram is approaching or just at the impact position. Otherwise, it is closed by the lift piston 25. When opened, port 56 places the end of the valve sleeve 40 having the larger area $A_2$ at reservoir pressure. The main inlet port 55 opens to the fixed volume chamber 33, axially between said main transfer port 54 and said valve sleeve outlet port 56. A lift chamber transfer port 57 opens said expansible lift chamber 32 to the transfer chamber 63 (not shown in FIG. 1). In this way, ports 54 and 57 are connected to each other.

Various seals are shown in the drawings for limiting leakage of hydraulic fluid between various chambers and members.

In most hydraulic impact drills it is as important to rotate the drill steel as it is to drive it or impact it. However, this invention is directed to the impacting mechanism of a hydraulic drill, the various means for rotating the drill steel being well known.

The operation of the impact tool will now be described with reference to FIGS. 2–5 in which the elements are numbered as in FIG. 1. In addition, the exhaust chamber 62 and the transfer chamber 63 are shown schematically. The housing comprising the casing 10, the port sleeve 11 and the heads 12 and 13 are shown as one piece for simplicity. Also, the drill steel is not shown.

Figure 2:
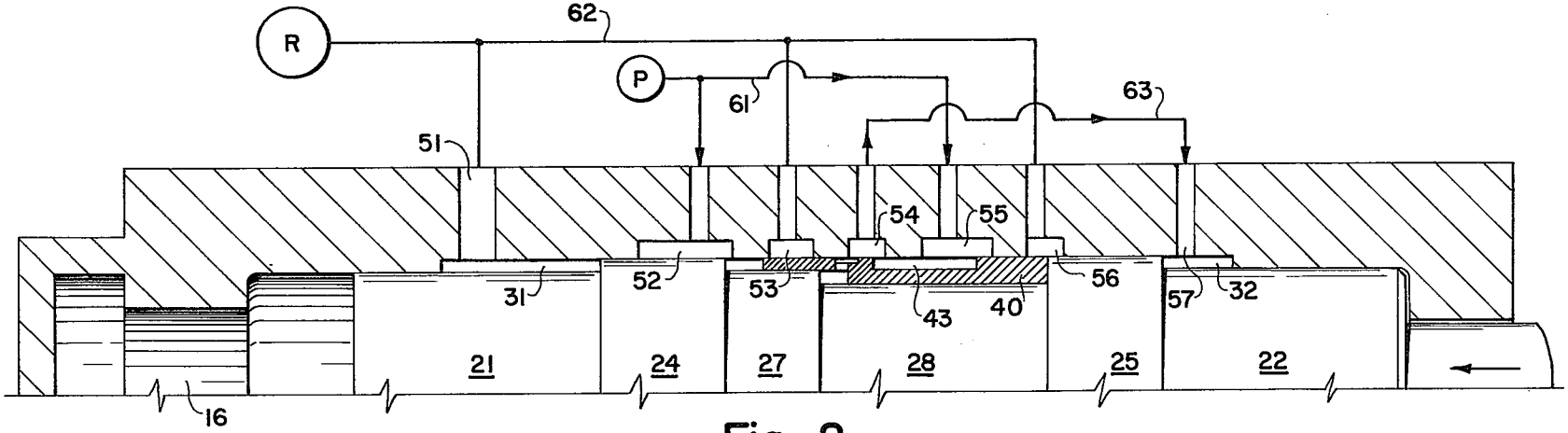
FIG. 2 is a schematic drawing of the impact tool according to this invention showing the ram and sleeve in the rest position.

Referring now to FIG. 2, the ram is shown at what might be termed the rest position in which it is fully moved toward the impact end of the housing. This position is somewhat past the position at which the ram strikes the drill steel or the impact position. Air or gas precharged to chamber 16 constantly maintains a force on the ram 20, thus at rest without application of hydraulic force from the pump, the position of the ram will be full against the impact end head. At rest, the position of the valve sleeve 40 is uncertain and immaterial. On application of hydraulic pressure, while the ram is in the impact or rest position, the valve sleeve will be subject to two forces. Pump pressure applied to valve inlet port 52 provides pump pressure to the smaller area $A_1$. The larger area $A_2$ at the other end of the valve sleeve will open to valve sleeve exhaust port 56, opposed only by hydraulic return back pressure. The greater pressure at port 52 moves the sleeve 40 in the impact direction against the lift piston 25.

At this instance, the valve sleeve positions the transfer slot or groove 43 so that hydraulic fluid from the pump passes by way of the main inlet port 55 through the groove 43 to the main transfer port 54 and then through the transfer chamber 63 to the lift chamber transport port 57 and thus to the lift chamber 32. In this way, the hydraulic fluid causes the lift chamber 32 to expand, moving the ram 20 against the air spring toward the stored energy end 1. At the same time hydraulic fluid in the swallow chamber 31 is returned to the hydraulic system reservoir.

Figure 3:
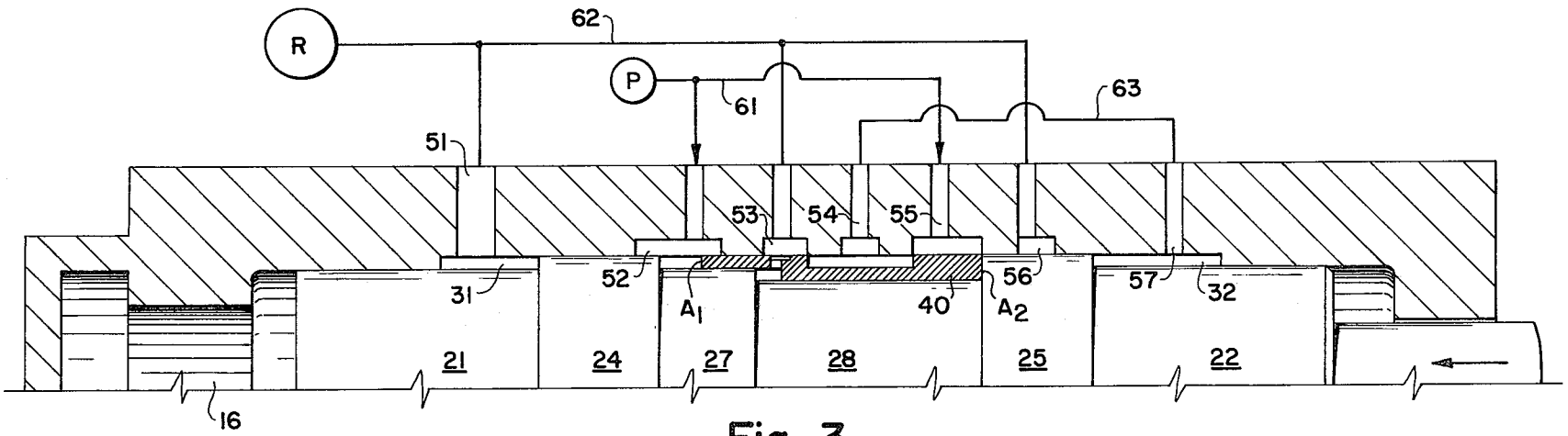
FIG. 3 is a schematic of an impact tool according to this invention showing the operational position where the sleeve is ready to move relative to the ram toward the energy storage position.
Figure 4:
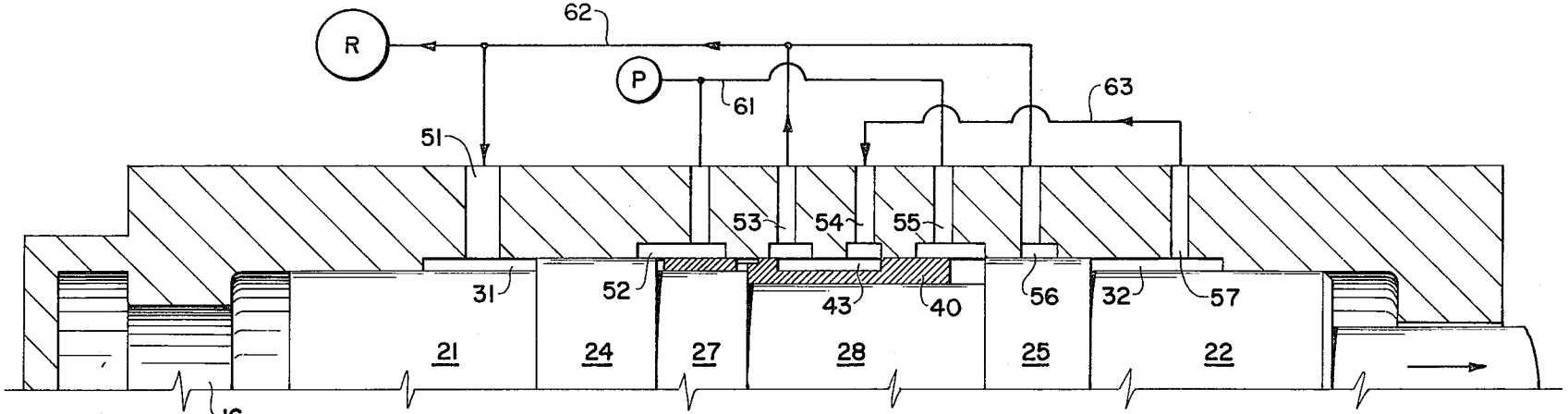
FIG. 4 is a schematic of an impact tool according to this invention showing the ram and sleeve in the stored energy position; and, FIG. 5 is a schematic of the impact tool according to this invention showing the operational position where the sleeve is ready to move relative to the ram toward the impact position.

As the ram 20 starts to move toward the stored energy end, it mechanically carries the valve sleeve 40 with it. Referring to FIG. 3, when the end of the valve sleeve having the larger area $A_2$ is exposed to the pump pressure as it enters the main inlet port 55, the valve sleeve is subjected to differential hydraulic forces. The pressure at ports 52 and 55 is roughly equal as both are connected. But, the area $A_2$ is larger than the area $A_1$. Thus, the valve sleeve moves toward the stored energy position relative to the ram. The shift of the slide valve 40 now enables groove 43 to connect transfer port 54 and exhaust port 53. FIG. 3 shows the position of the sleeve and the ram when the area $A_2$ is just entering the main inlet port 55 just before shift of the valve sleeve 40. FIG. 4 shows the position of the ram and the valve sleeve just after the shift of the valve sleeve.

Referring to FIG. 4, with ports 53 and 54 connected by groove 43 the lift chamber 32 is no longer connected to the pump but to the swallow chamber 31 and reservoir. The ram is now subjected to the maximum force of the compressed gas in chamber 16. Fluid from lift chamber 32 is forced to flow at a minimum and constant resistance by way of port 57, chamber 63, port 54, the groove 43, port 53, chamber 62 and port 51 to swallow chamber 31. Chamber 31 enlarges exactly as chamber 32 gets smaller. At the most critical operational phase (the work stroke) when any back pressure would reduce the energy available to accelerate the ram toward the impact position, the hydraulic fluid is simply moved from one end of the piston to the other.

It is moved through major size passages. It is not moved to a distant reservoir through hoses which would result in a certain back pressure.

Figure 5:
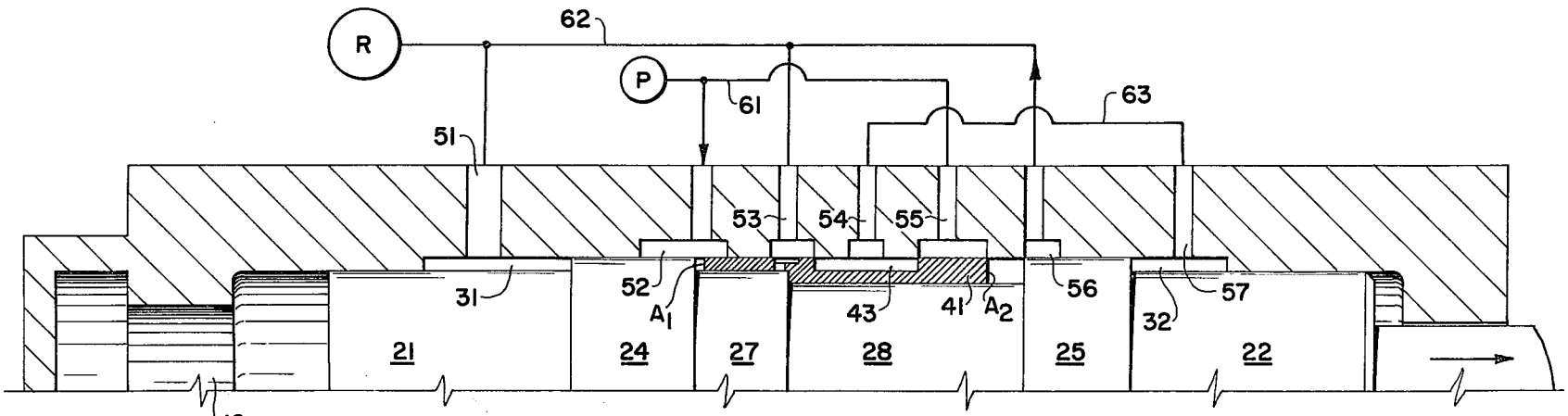

The ram, during the initial part of its work stroke (See FIG. 4); that is, during the time it is being accelerated toward the impact position, mechanically carries the valve sleeve toward the impact position. The ram carries the valve sleeve until the piston 25 opens the exhaust port 56. FIG. 5 shows the piston 25 just exposing the port 56. At that time, the large area $A_2$ becomes exposed to reservoir pressure. Hence, the sleeve, being subject to different forces, moves toward the impact direction relative to the ram. Valve sleeve inlet port 52 is at a greater pressure than the valve sleeve outlet port 56 and the differential pressure is developed in spite of the difference in areas $A_1$ and $A_2$. The valve sleeve then shifts and the parts are generally in the position shown in FIG. 2. The reversal of the ram is not immediate because of the compressibility of the hydraulic oil, the expansion of the hoses and the compressiblity of air entrained within the hydraulic fluid. The piston is cushioned and reverse is started; that is, the next compression stroke is started after the drill steel is struck or at such a point in its travel when the drill steel is in place. The resistance is developed by the closing off of port 54 and by the development of flow and thus pressure by the pump against the piston via ports 55, 54 and 57. Hence, when the tool runs without the drill steel against the rock, the forward travel of the ram is cushioned and limited.

The next compression stroke is substantially identical to the compression stroke first described, except that the piston may not have gone as far forward due to the resistance of the drilling operation.

Oil in chamber 34 is free to pass to and from exhaust port 53 through the sleeve port 44. Thus, the oil in chamber 34 has no influence on the sleeve.

Having thus described my invention in detail with the particularity as required by the patent laws, what is desired protected by Letters Patent is set forth in the following claims.

We claim:

1. A hydraulic impact tool for use in a hydraulic system comprising a pump, hydraulic fluid, and reservoir, said tool comprising:

A. a housing defining a cylindrical bore having a central portion of increased section, B. a ram slidable in the housing between stored energy and impact positions.

C. an energy storage means for biasing the ram toward the impact position,

D. said ram having lift and closure cylindrical pistons secured thereto so that the housing, the ram and the pistons define at least two chambers, one between the pistons having a fixed volume and an expansible volume lift chamber, E. said ram between said pistons having two cylindrical portions of different cross section, F. axially spaced ports comprising:

at least one main transfer port opening into said fixed volume chamber, at least one main exhaust port opening to said fixed volume chamber, at least one slid valve exhaust port opening to said fixed volume chamber but closable by said lift piston on said ram, at least one main inlet port opening to said fixed volume chamber, at least one lift chamber transfer port opening into said expansible volume lift chamber, all said main transfer and lift chamber transfer ports being in direct communication, G. a cylindrical valve sleeve positioned within the said fixed volume chamber and movable relative to the ram and housing, 1. said sleeve having a radial end surface having an area $A_1$, 2. said sleeve having another radial end surface having an area A2 such that the area $A_1$ is less than the area $A_2$, 3. said sleeve having transfer means thereon for connecting either the main exhaust port with the main transfer port or the main inlet port with the main transfer port, the aforesaid ram, valve sleeve and axially spaced ports arranged such that the sleeve is carried mechanically in one direction by the lift piston until the surface $A_2$ enters the main inlet port and thereafter the sleeve is moved relative to the ram by hydraulic pressure and such that the slide is carried mechanically in the other direction until the ram lift piston opens the slide valve exhaust port and thereafter, the valve sleeve is moved relative to the ram by hydraulic pressure.

2. A hydraulic impact tool for use in a hydraulic system comprising a pump, hydraulic fluid, and reservoir, said tool comprising:

A. a housing defining a cylindrical bore having a central portion of increased section, B. a ram slidable in the housing between stored energy and impact positions, C. an energy storage means for biasing the ram toward the impact position, D. said ram having lift and closure cylindrical pistons secured thereto so that the housing, the ram and the pistons define three chambers, one between the pistons having a fixed volume, an expansible volume swallow chamber which increases in volume as the ram moves to the impact position, an expansible volume lift chamber that increases in volume as the ram moves to the stored energy position, the combined volume of said lift and swallow chambers being constant for all positions of said ram, E. said ram between said pistons having two cylindrical portions of different cross section, F. axially spaced ports comprising:

1. at least one swallow chamber exhaust port opening to said expansible swallow chamber and said hydraulic reservoir, 2. at least one valve sleeve inlet port opening to the fixed volume chamber, 3. at least one main transfer port opening into said fixed volume chamber, 4. at least one main exhaust port opening to said fixed volume chamber, 5. at least one valve sleeve exhaust port opening to said fixed volume chamber when the ram is approaching or just at the impact position but otherwise sealed by the ram, 6. at least one main inlet port opening to said fixed volume chamber, 7. at least one lift chamber transfer port opening into said expansible volume lift chamber, said main transfer and lift chamber transfer ports being in direct communication, G. a cylindrical valve sleeve positioned within the said fixed volume chamber, 1. said sleeve having a portion of reduced thickness arranged to slide between the cylindrical bore and the portion of the ram having a larger section, said portion terminating with a radial end surface having an area $A_1$,
2. said sleeve having another portion for sliding between the cylindrical bore and the portion of the ram having the smaller section, said portion terminating with a radial end surface having an area $A_2$ such that the area $A_1$ is less than the area $A_2$,
3. said sleeve having transfer means thereon for connecting either the main exhaust port with the main transfer port or the main inlet port with the main transfer port, the aforesaid ram, valve sleeve and axially spaced ports arranged such that the valve sleeve is carried mechanically toward the stored energy position by the lift piston until the surface $A_2$ communicates with the main inlet port and thereafter the sleeve is moved relative to the ram by hydraulic pressure to connect the main transfer port with the main exhaust port enabling rapid transfer of hydraulic fluid from the expansible volume lift chamber to the expansible volume chamber which in turn enables the energy storage means to accelerate the ram toward the impact position, and such that the sleeve is carried mechanically toward the impact position by the closure piston until the ram opens the valve sleeve exhaust port and thereafter, the sleeve is moved relative to the ram by hydraulic pressure to connect the main transfer port to the main inlet port thereby connecting the pump pressure to the expansible volume lift chamber to cushion the movement of the ram past the impact position and to initiate the movement of the ram toward the stored energy position.

3. A hydraulic impact tool for use in a hydraulic system comprising a pump, hydraulic fluid, and reservoir, said tool comprising:

A. a housing defining a cylindrical bore having a central portion of increased section, B. a ram slidable in the housing between stored energy and impact positions, C. an energy storage means for biasing the ram toward the impact position, D. said ram having lift and closure cylindrical pistons secured thereto so that the housing, the ram and the pistons define three chambers, one between the pistons having a fixed volume, an expansible volume swallow chamber adjacent the closure piston which increases in volume as the ram moves to the impact position, an expansible volume lift chamber adjacent the lift piston that increases in volume as the ram moves to the stored energy position, the combined volume of said lift and swallow chambers being constant for all positions of said ram, E. said ram between said pistons having two cylindrical portions of different cross section, the larger section being near the closure piston, F. seven axially spaced ports comprising:

1. at least one swallow chamber exhaust port opening to said expansible swallow chamber and the hydraulic reservoir,
2. at least one valve sleeve inlet port opening to the fixed volume chamber in the vicinity of the closure piston,
3. at least one main transfer port opening centrally into said fixed volume chamber,
4. at least one main exhaust port opening to said fixed volume chamber axially between said valve sleeve inlet port and said main transfer port,
5. at least one valve sleeve exhaust port opening to said fixed volume chamber when the ram is approaching or just at the impact position but otherwise sealed by said lift piston,
6. at least one main inlet port opening to said fixed volume chamber axially between said main transfer port and said valve sleeve outlet port,
7. at least one lift chamber transfer port opening into said expansible volume lift chamber, said transfer and main lift chamber transfer ports being in direct communication, G. a cylindrical valve sleeve positioned within the said fixed volume chamber, 1. said sleeve having a portion of reduced thickness arranged to slide between the cylindrical bore and the portion of the ram having a larger section, said portion of the sleeve terminating with a radial end surface having an area $A_1$,
2. said sleeve having another portion for sliding between the cylindrical bore and the portion of the ram having the smaller section, said portion of the sleeve terminating with a radial end surface having an area $A_2$ such that the area $A_1$ is less than the area $A_2$,
3. said sleeve having transfer means thereon for connecting either the main exhaust port with the main transfer port or the main inlet port with the main transfer port, the aforesaid ram, valve sleeve and axially spaced ports arranged such that the sleeve is carried mechanically toward the stored energy position by the lift piston until the surface $A_2$ enters the main inlet port and thereafter the sleeve is moved relative to the ram by hydraulic pressure to connect the main transfer port with the main exhaust port enabling rapid transfer of hydraulic fluid from the expansible volume lift chamber to the expansible volume swallow chamber which in turn enables the energy storage means to accelerate the ram toward the impact position, such that the sleeve is carried mechanically toward the impact position by the closure piston until the lift piston opens the valve sleeve exhaust port and thereafter the sleeve is moved relative to the ram by hydraulic pressure to connect the main transfer port to the main inlet port thereby connecting pump pressure to the expansible volume lift chamber to cushion the movement of the ram past the impact position and to initiate the movement of the ram toward the stored energy position.

4. A hydraulic impact tool for use in a hydraulic system including a pump, hydraulic fluid and reservoir comprising:

A. a housing defining a cylindrical bore having a central portion of increased diameter forming a cylinder, B. a ram including piston surfaces slidable in the housing, A lift chamber formed by the ram and housing, C. means at one end of said bore to store energy as the ram is moved thereto, D. means at the other end of said bore to be impacted by said ram, E. a hollow cylindrical valve sleeve in the cylinder moveable relative to the ram and housing, the valve sleeve having an end of small area constantly in communication with the hydraulic pump pressure and an end of larger area which may be brought into communication alternately with either pump pressure or the reservoir, F. inlet, outlet and transfer porting which cooperate with the valve sleeve to direct the hydraulic fluid from the pump to the lift chamber to move the ram to the stored energy position and to release fluid from the lift chamber to permit the ram to accelerate toward the impact position, the aforesaid ram, valve sleeve and porting arranged such that the ram carries the valve sleeve mechanically in one direction until the large area end of the sleeve is in communication with pump pressure at which time the sleeve is hydraulically actuated in the direction in which it was being mechanically carried and such that the ram carries the valve sleeve mechanically in the other direction until the large area end of the sleeve is in communication with the reservoir at which time the sleeve is hydraulically actuated in the direction in which it was being mechanically carried.

* * * * *

UNITED STATES PATENT AND TRADEMARK OFFICE

CERTIFICATE OF CORRECTION

PATENT NO. : 4,011,795

DATED : March 15, 1977

INVENTOR(S) : Henry P. Barthe et al.

It is certified that error appears in the above-identified patent and that said Letters Patent are hereby corrected as shown below:

Column 2 Line 39 "flange" should read --flanges--.
Column 4 Line 33 "transport port" should read --transfer port--.

Claim 1 - Column 6 Line 2 - Delete the word --all--.
Claim 2 - Column 7 Line 24 "volume chamber" should read --volume swallow chamber--.
Claim 3 Column 8 Line 13 "transfer and main" should read --main transfer and--.
Claim 4 Column 8 Line 59 "A" should read --a--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*